United States Patent [19]

Weigl

[11] 4,248,434

[45] Feb. 3, 1981

[54] BRIDGE GAME FOR TWO OR THREE

[76] Inventor: William Weigl, 1805 Conwood Dr., Troy, Ohio 45373

[21] Appl. No.: 85,998

[22] Filed: Oct. 18, 1979

[51] Int. Cl.³ ..... A63F 1/00

[52] U.S. Cl. ..... 273/296; 273/304; 273/305; 273/306; 273/148 R

[58] Field of Search ..... 273/148 R, 148 A, 149 P, 273/296, 304, 305, 306; 35/8 B

[56] References Cited

U.S. PATENT DOCUMENTS

| | | | |
|---|---|---|---|
| D. 210,227 | 2/1968 | Taxel | 273/148 R UX |
| 1,887,203 | 11/1932 | Hoke | 273/148 A UX |
| 2,133,746 | 10/1938 | Hawgood | 273/304 |
| 4,009,884 | 3/1977 | Weigl | 273/149 P X |

FOREIGN PATENT DOCUMENTS

| | | | |
|---|---|---|---|
| 488797 | 12/1952 | Canada | 273/304 |
| 737504 | 9/1955 | United Kingdom | 273/304 |

*Primary Examiner*—Anton O. Oechsle

[57] ABSTRACT

Bridge game for two or three players who competitively bid for a face-down dummy hand which is incapable of verbal response but is capable of providing an approximate point count, indication of the suits of the majority of cards thereof and the specific number of Aces and Kings therein when called upon to do so, all without having any markings on the backs of said cards from which such information can be determined.

18 Claims, 23 Drawing Figures

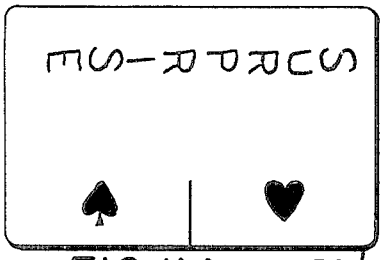
FIG. 11A
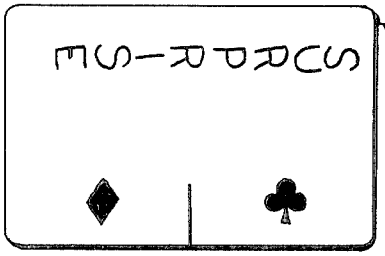
FIG. 11B
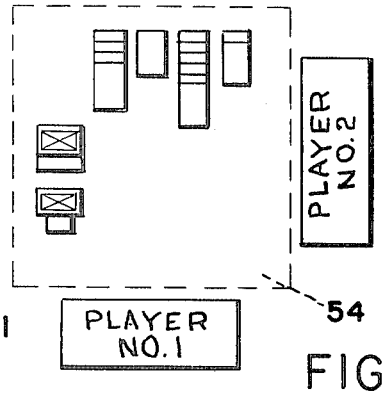
FIG. 13
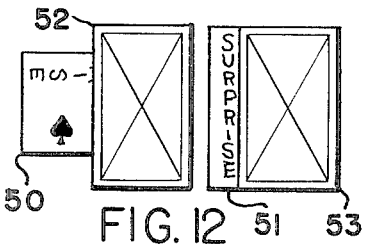
FIG. 12
FIG. 14
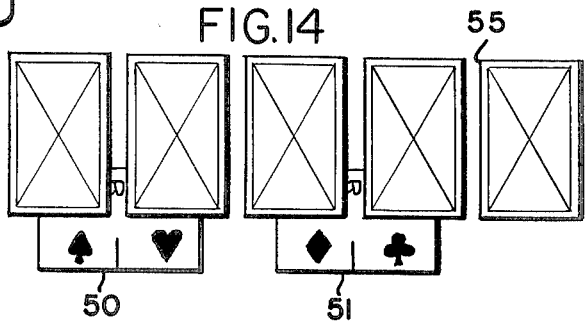
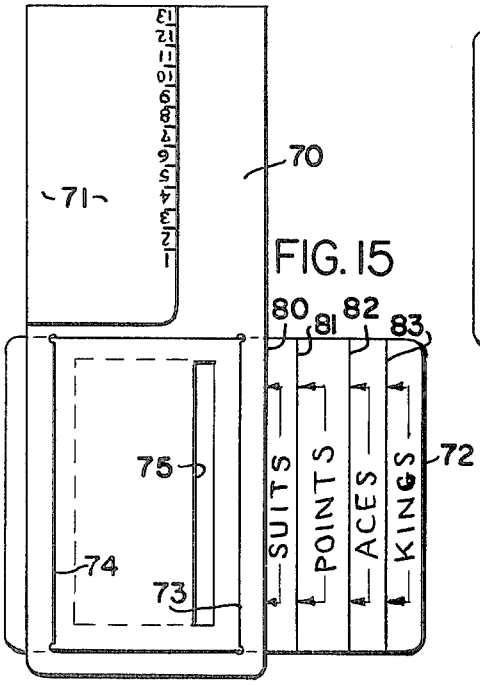
FIG. 15
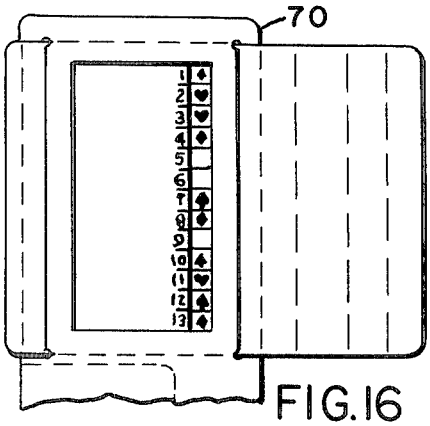
FIG. 16
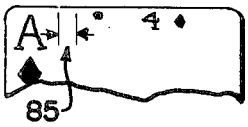
FIG. 17

BRIDGE GAME FOR TWO OR THREE

BACKGROUND OF THE INVENTION

This game relates to the card game of contract bridge. It permits two or three persons to bid and play the conventional game of bridge, using a standard point count bidding system of the type used in the four-handed version of the game. Regular four-handed contract bridge as played by two pairs of opposing teams consists of two primary parts, (1) bidding and (2) play of the hand. Bidding occurs with all hands "closed", i.e., being viewed solely by the individual holding the hand. Various bidding systems have been developed for partners to generally define their closed hands to each other in an attempt to reach a contract that will produce the highest score possible when their combined hands are subsequently played. The person on the highest bidding team who first bids the suit in which the contract is to be played is known as Declarer. The Declarer's partner is known as the dummy hand, commonly just called Dummy. Once the defending team presents the opening lead card of the first trick, Dummy displays all cards of his entire hand face up on the table and sits out the hand while Declarer plays both his and Dummy's hands against the defending team. Thus, each of the three active players can view his own and Dummy's hand, but cannot see the other two concealed hands. The goal of the defending team is to improve their score by defeating or "setting" the contract which was bid by their opponents.

As discussed in my U.S. Pat. Nos. 4,009,884 and 4,119,322, numerous attempts have been made to develop a 2 or 3-handed bridge game which has the basic bidding and playing aspects of the true 4-handed game. Until the concepts of my earlier patents were developed, however, no bridge game appears to have even remotely approached that goal. Such other games lacked not only the accuracy of bidding required, but were generally played quite differently than the 4-handed game as well.

SUMMARY OF THE INVENTION

The present invention embodies the principal advantageous features of my earlier aforementioned patents, and adds to them certain elements which eliminate some of their individual disadvantages. For example, the main disadvantage of the game of U.S. Pat. No. 4,009,884 resides in the requirement that the cards have coded preprinted backs for dealing purposes. After repeated use, the coding can be memorized to some extent so that certain key high cards can be recognized at crucial times during bidding and play. Such coding is well-known for predealing of 4-handed duplicate bridge hands. It enabled the original development of 2 and 3-handed bridge in which auxiliary means was provided to enable a bid to be made by a closed, predetermined Dummy hand. To that end, it serves a useful purpose despite its one acknowledged disadvantage.

The bridge game of U.S. Pat. No. 4,119,322 was developed in recognition of the deficiency of using coded card backs for dealing purposes according to my earlier patent. Its commercial production posed certain problems, however. The goal was to provide all 52 cards with backs that "appeared" to be identical, but in actuality, some of which were ever so slightly different. The card backs were to look the same when in disarray, as during dealing or when held by a player. However, the Aces were to be distinguishable from all other cards, as also were the Kings, without viewing the faces of any of the cards even though their backs appeared the same as the other cards. This was to enable slam bidding, well understood in contract bridge as an attempt to take all or all but one of the 13 tricks of a hand, known as a Grand Slam and Small Slam, respectively. In one version of the U.S. Pat. No. 4,119,322 invention, alignment marks were placed on the backs of the cards, at the edge thereof. The marks of the Aces had to be slightly offset from the other 48 cards of the deck, so that by aligning several cards, those which were Aces could be visually noted. This presented a manufacturing problem because of the high accuracy with which the cards had to be produced. The accuracy is attainable, but only at greater printing and cutting cost than if such requirement did not exist.

This invention eliminates the need for any marking whatsoever of the card backs. It utilizes marks on the card faces in conjunction with auxiliary masking means which reveals those marks without showing any other markings identifying the masked card or cards. The marks reveal only certain limited information about the card or cards. Through the face markings and associated masking means, I have provided a standard bridge game playable by two or three persons, which is less expensive to produce and which is devoid of back-marking of the cards. This is accomplished while retaining the desirable bidding and playing features of my earlier noted patents, and further improving play of the 2-handed game. In addition by enabling identification of the suit of any particular card or cards an added element is provided to the 2-handed version of my earlier games. A fourth closed hand, referred to herein as Defender's Partner, can follow suit, thus allowing the Declarer to draw and count trump. It also supplies Defender with some additional strength, enabling all bidding to be at standard, rather than some arbitrary point count.

BRIEF DESCRIPTION OF THE DRAWINGS

FIGS. 11A and 11B illustrate "Surprise" Cards which may take the places of the conventional "Jokers"

and are used in conjunction with a second defending hand in the 2-handed version of this game.

Figure 3:
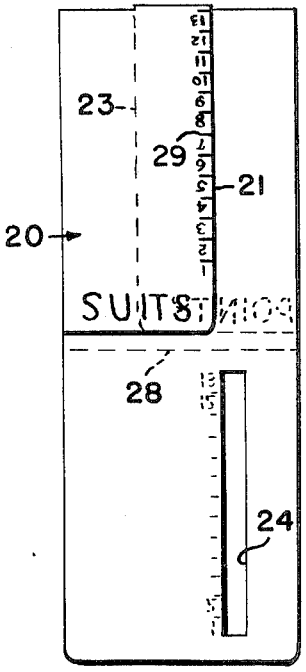
FIG. 3 illustrates one form of card masking means called herein the Point Count Jacket.
Figure 9A:
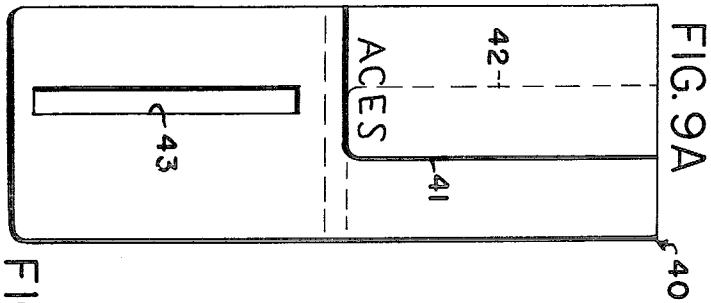
FIGS. 9A, 9B, 10A and 10B illustrate the slam Jacket used to determine how many Aces and Kings are contained in Dummy.

FIG. 12 illustrates how the Surprise Cards may be used in laying out the second defending hand referred to in connection with FIGS. 11A and 11B when playing at a suit contract, FIG. 13 shows the location of the four hands when playing the 2-handed game at a table, FIG. 14 is a view of the second defending hand as laid out when playing at a No Trump contract, FIGS. 15 and 16 show opposite sides of a version of Jacket which combines the features of the two Jackets of FIGS. 3 and 9A, and FIG. 17 shows a preferred arrangement of markings on a playing card used with the Jacket of FIG. 15.

DESCRIPTION OF THE PREFERRED EMBODIMENTS

The description is divided into three parts:

(1) Features applicable to both 2 and 3-handed bridge, (2) Features applicable only to 3-handed bridge, and (3) Features applicable only to 2-handed bridge.

(1) APPLICABLE TO BOTH 2 AND 3-HANDED BRIDGE

All players may bid for a 13 card Dummy hand which is dealt face down. The faces are kept from being viewed by the players during bidding, except for selected face portions which are capable of communicating (a) approximate point value, (b) suits, (c) actual number of Aces or (d) actual number of Kings. This is the same kind of information conveyed by a verbally responding partner during the regular 4-handed game.

Figure 1:
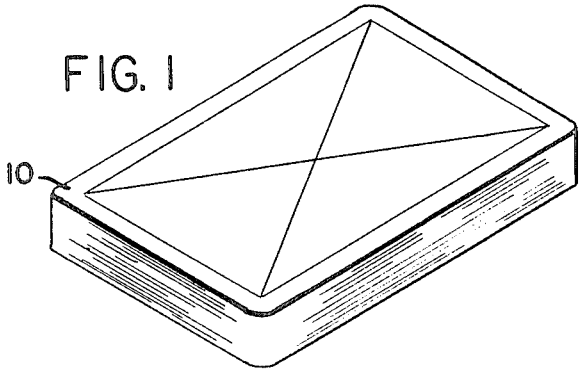
FIG. 1 shows a standard 52 card bridge deck having 4 suits each extending from Ace through King.

A deck 10 of cards consists of the usual four suits of Spades, Hearts, Diamonds and Clubs, 13 cards each. The cards may be provided with identical backs which may be either blank or printed, but for a convenience to be mentioned later, preferably have a border as shown in FIG. 1.

Figure 2A:
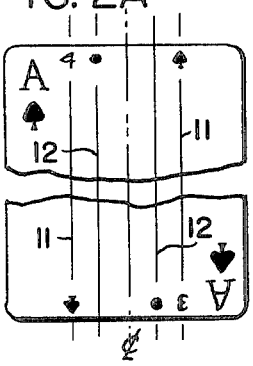
FIGS. 2A–2D show portions of 4 different cards of the deck of FIG. 1, with the preferred form of markings according to the invention.

FIGS. 2A–2D show fragments of four different cards of the deck 10 to illustrate the types and purposes of and reason for the markings which are a significant element of the invention. In FIG. 2A the Ace of Spades shows a pair of imaginary columns or centerlines 11 and a pair of columns or centerlines 12 equally spaced on opposite sides of the card centerline ℄. The columns 11, when viewing the card at the top provide a point marking at the left and a suit marking at the right. The bottom is shown to be the reverse, but when the bottom becomes the top, the point marking is again on the left. Note the point count is shown as 4 at the top and 3 at the bottom. Depending on which side is up, only one of those numbers will be viewable. Although high card points in standard point count bidding are 4, 3, 2, and 1 respectively for Aces, Kings, Queens and Jacks, to obtain an average point count of an unseen Dummy, the cards may be given different points on opposite ends. Otherwise, seeing a 3, for example, would signify a King; but in this game, a 3 can be an Ace, King or even a Queen.

In addition to the point and suit marking, the left column 12 as viewed from the top (and the right column 12 at the bottom) contain a dot. This, as will be seen later indicates that the card is an Ace when bidding for a Slam.

Figure 2B:
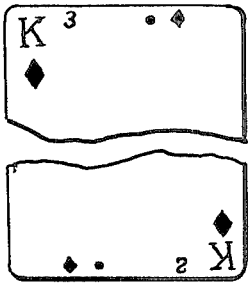
Figure 2C:
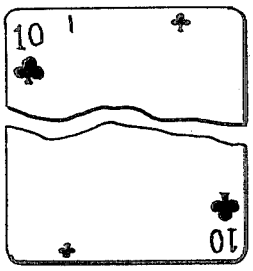
Figure 2D:
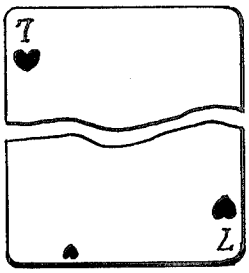

Although the columns 11 and 12 are not shown in FIGS. 2B–2D, the markings on those cards correspond in columnar fashion to the location in FIG. 2A. The King of Diamonds can be given a point value of either 3 or 2 points depending on which end is up, shows by means of a dot in the right column 12 (at the top) that the card is a King for Slam bidding and shows the suit to be Diamonds in the far right column 11.

FIG. 2C shows a point mark of 1 at the top end only. Normally a Ten has no high card point value, but I prefer that the Tens of this invention each carry a 1 at one end only, as do several of the Jacks and one or two Queens.

FIG. 2D shows a "low" card, that is, one having no high point value for purposes of taking tricks. Thus it carries no point marking, but it and all other cards should carry a suit marking. Note however, that it has no Heart at the top where column 11 would be, but only at the bottom. Arbitrarily, five cards in each suit have a suit marking at one end only. This results, as will be seen later, in not all cards of Dummy revealing their suits, providing a certain element of chance in bidding, such as in the true 4-handed game. Actually, this game has the capability of providing more details about the Dummy hand than the typical partner can provide verbally. The point markings and how many suit markings are omitted, if any, can be varied to increase or decrease the chance element of the game. Any of the cards, high or low, and preferably different valued cards in each suit have the omitted suit markings. Optionally, all cards can have suit markings at both ends, but only ten or eleven cards of Dummy be viewed.

FIGS. 3 through 7 illustrate the Point Count Jacket 20, showing how the Dummy is located therein, and how the Jacket serves as a masking means to reveal the average point count and suits of approximately ten or eleven of the Dummy cards in a typical hand. Jacket 20 has a pocket portion 21 and a flap 22 which interacts with a pocket portion 23 on its opposite side. It also has a slot or window 24 through which suits of Dummy are revealed in FIG. 5 and points of Dummy are revealed in FIG. 7. In addition, a fold-line 28 allows the Jacket 20 to be folded to the size of the cards if desired to pack all parts of the game in a container the size of the deck 10.

Figure 4:
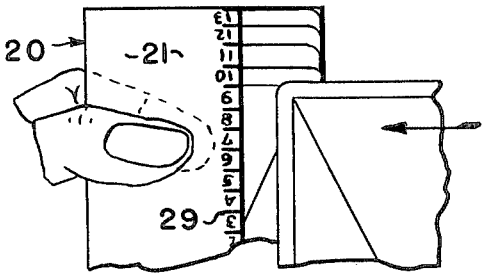
FIG. 4 is a partial view of the Jacket of FIG. 3 showing the manner in which cards of a Dummy hand may be arranged therein.
Figure 6:
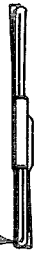

When Dummy is to be evaluated for bidding purposes, the individual cards are inserted by the non-dealer in the direction of the arrow in FIG. 4, with the top edges of the cards aligning with marks 29 at the edge of pocket 21. This is done with Jacket 21 having the word SUITS facing the person. At the time of insertion, the Jacket should be lightly pinched between the left thumb and forefinger to stabilize cards which have already been inserted. If cards are placed into pocket 21 other than in the direction of the arrow, there is a possibility of disarrangement of cards already placed therein. The bottom of the pocket 21 is wider toward the center of the Jacket 20 to accommodate the increased thickness of the cards, as seen in FIG. 6.

Figure 5:
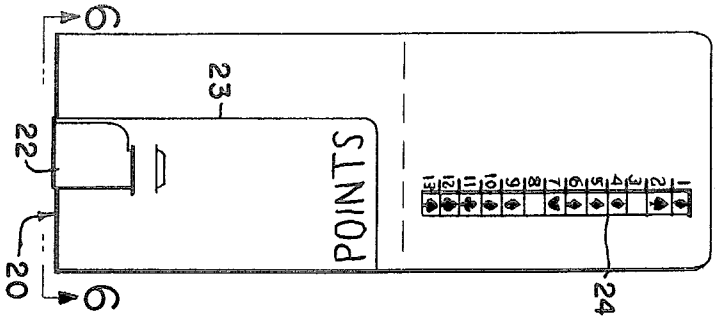
FIGS. 5 and 6 illustrate a plan and an end view of the Jacket of FIG. 3, loaded with the Dummy hand, revealing solely the suits of the majority of the cards of Dummy in FIG. 5.
Figure 7:
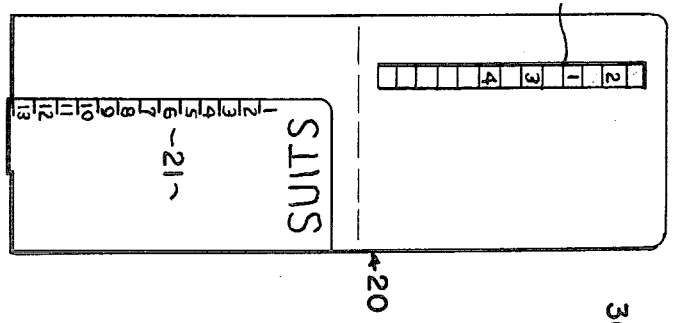
FIG. 7 is a view of the Jacket of FIG. 3 with the Dummy hand loaded in the opposite side of the Jacket and revealing solely the average point count of the cards of Dummy.
Figure 8:
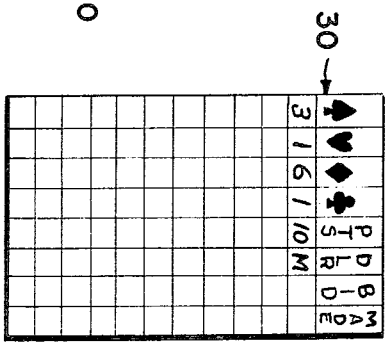
FIG. 8 shows the Dummy Valuation Pad on which the general information revealed in FIGS. 5 and 7 has been recorded prior to bidding.

After all 13 cards of Dummy have been placed into pocket 21, the Jacket is turned over, top for bottom to the position of FIG. 5. At this time the suit markings of Dummy come into view through slot 24. The non-dealer advises how many cards of each suit are contained in Dummy, and the dealer records that information in the appropriate column of the Dummy Valuation Pad 30, as shown in FIG. 8. While still gripping Dummy and Jacket 20, non-dealer flips them back to the position of FIG. 3 and removes the overlapped Dummy hand while face down. The Jacket 20 is then flipped over by itself, with the word POINTS facing the person, and the face down overlapped Dummy is placed as a pack into pocket 23. Upon doing this and making sure the side edges of Dummy are squared up with the Jacket 20, the Jacket is again flipped over, top for bottom, appearing to the viewer as in FIG. 7. The slot 24 now reveals the point markings on the cards of Dummy. These are totaled and read to the dealer, who records the total in the column entitled PTS on Pad 30.

At this time, the players may commence bidding, dealer first and proceeding clockwise alternately, unless one player bids for Slam. If a Slam is not sought, the high bidder becomes Declarer, and the player to his left (unless only two are playing) commences with the opening lead for the first trick. Dummy is then fully exposed in standard fashion and play proceeds.

If one player seeks a Slam bid, he is immediately entitled to know the exact number of Aces (and Kings also, if the appropriate bid is entered) contained in Dummy. Until the Slam bidder completes his bidding, the other player or players are not permitted to enter an intervening bid in the preferred form of the game. A Slam bid may be entered according to any of the standard conventions, Blackwood, Gerber, etc. Since this is adequately described in my earlier U.S. Pat. No. 4,119,322, suffice it to say here that Dummy bids by responding automatically to a Slam Bid to indicate the precise number of Aces or Kings in Dummy.

Figure 10A:
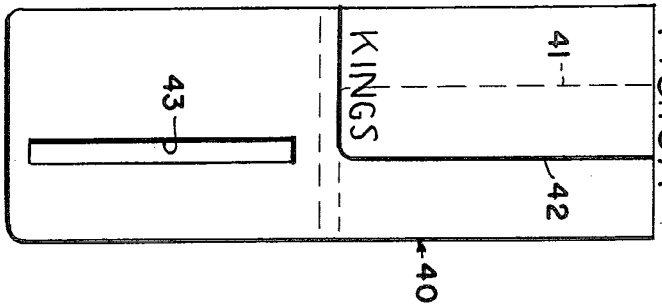
Figure 9B:
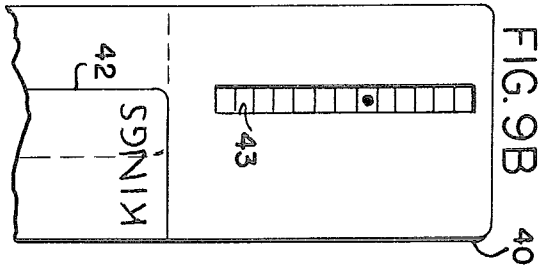
Figure 10B:
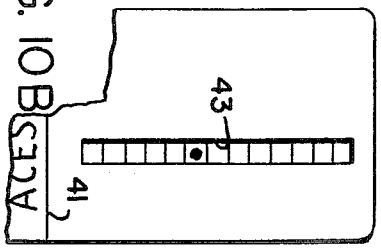

Slam Jacket 40 is provided with pockets 41 and 42 and a slot or window 43, similar to corresponding elements of the Point Count Jacket 20. It needs no marks such as 29, since Dummy was previously overlapped in Jacket 20 and is kept available in that fashion in case a Slam bid is entered. With Slam Jacket 40 having the word ACES up and facing the Slam bidder, the overlapped Dummy is lifted from the Jacket 20 and placed in pocket 41 of Jacket 40. When this has been done, Jacket 40 with the overlapped Dummy is flipped over, top for bottom and appears as in FIG. 9B. The number of dots seen in slot 40 is noted and Dummy must respond to the Slam bid. The Slam bidder may elect to play the hand at Dummy's bid, bid at a higher level and indicate the Slam bid is being discontinued, or enter a continuing Slam bid, asking Dummy to reveal the number of Kings therein. If the latter is done, Jacket 40 is flipped over again, the overlapped Dummy removed intact, Jacket 40 again turned over to the FIG. 10A position, and the overlapped Dummy reinserted into pocket 42. Once done and the card edges are squared up with Jacket 40, the Jacket is flipped over, top for bottom, to the FIG. 10B position in which it reveals Kings. Dummy again automatically responds according to standard Slam bidding procedure. The Slam bidder may accept playing at Dummy's bid or rebid his own hand. At this point alternate bidding resumes, with appropriate Doubling or Redoubling according to the standard 4-handed game.

(2) 3-HANDED BRIDGE

The present game not only provides accurate bidding, but play of the hand is identical to the 4-handed game. As such, it is ideal to allow two tables of 3-handed bridge to substitute for situations where a fourth couple is not available. It is also very valuable for teaching the game of bridge if one of the players can instruct as bidding and play proceeds.

In dealing, the three players should be equally spaced around a table. The dealer should deal the fourth hand opposite himself, and that hand should be the blind dummy for which all players may bid.

Bidding ends when all three players pass in succession, or when two players pass, one bids, and the two passers pass again. Doubling or Redoubling is regarded the same as a pass for purposes of concluding bidding.

Play takes place with two players defending as partners against Declarer. Scoring is done in three columns, one for each player. When two defenders defeat a contract, each scores the full setting score in his own column.

(3) 2-HANDED BRIDGE

In the 2-handed game according to my U.S. Pat. No. 4,119,322, only three hands were played (one held by each player and one by Dummy) and the fourth hand was a "dead" hand which was kept out of play. While this provided reasonably good play under most circumstances, the single defender had a disadvantage by having no defending partner to lead to, or to lead to him. The dead hand could have had cards played off the top one at a time, but there was only a 25% chance of it following suit on any trick. Also, if the dead hand were allowed to trump in, it would be truely disruptive to Declarer's planning the play of the hand. Most importantly, it prevented Declarer from drawing and counting trump properly.

Bidding for Dummy is as noted in Section (1), with bidding ending when both players pass in succession, or one player passes on two consecutive opportunities.

The Point Count Jacket of this invention enables play of a closed defending hand, with the hand being in segregated packs according to suits. When playing at a trump contract, trump is segregated from the other cards. A trump lead requires that hand, referred to as Defender's Partner, to follow trump. When playing at No Trump, all suits are preferably segregated in packs and must follow suit except where the suit is unknown.

Bridge decks are normally printed 54 cards per sheet, 52 being playing cards and two being Jokers. For this game, instead of Jokers, I provide Surprise Cards 50 and 51 used solely for 2-handed play in conjunction with Defender's Partner.

Defender's Partner is segregated in packs 52 and 53 and placed over Surprise Cards 50 and 51 as shown in FIG. 12. Segregation takes place immediately after bidding is concluded and Defender makes the opening lead from his own hand. While Declarer is laying out Dummy opposite himself, Defender takes the Point Count Jacket 20 with SUITS facing up, overlaps Partner as in FIG. 4 and views the suits of Partner through slot 24 as in FIG. 5. If Spades is trump, for example, those of the numbers 1–13 at the left of slot 24 which are Spades are noted (and marked down if necessary). Then, by turning Jacket 20 back over and seeing the corresponding numbers 1–13 at the edge of pocket 21, those which are Spades are removed from the rest. They form pack 52 and are placed adjacent the Spade on Surprise Card 50. Pack 53, which contains all cards of the other three suits plus any Spade trump card which is not marked on one end, is placed over the suit markings on Card 51, with the word "Surprise" showing. FIG. 13 illustrates the two players, Dummy and Defender's Partner as they are normally positioned around a table 54. The players are adjacent each other, making it convenient for side-by-side play of the 2-handed game on serving trays of an airplane.

If the game is to be played at a No Trump contract, all four suits are segregated using the SUITS side of the Point Count Jacket as before. The four packs are located opposite Defender in Defender's Partner position as shown in FIG. 14. In addition, a fifth pack 55 is usually present, this being those cards for which no suit marking appeared in the slot 24 of Jacket 20. If all cards are provided with suit markings at both ends, three cards should be located in pack 55 each time.

In playing Defender's Partner in a suit contract, Partner must play from pack 52 when trump is led, and from pack 53 when any other suit is led, until one or the other is depleted. If Defender's Partner takes a trick, typically by finding a trump in pack 53 or a high trump card in pack 52, Defender can lead from either pack at the next trick. When playing at No Trump, Defender's Partner must follow suit, and if out, play from pack 55. If both packs are depleted, Defender may play the top card of any remaining pack. In addition, Defender can lead from any pack of Defender's Partner after having taken a trick.

FIGS. 15 and 16 show an alternate version of the Jackets in which a single Jacket 70 with a pocket 71 is provided for overlapping Dummy (and also Defender's Partner when playing 2-handed bridge). A slide 72 is guided in slits 73, 74 to present a slot or window 75 to different columns on the card faces. With Dummy in place in Jacket 70, face down and overlapped, card 72 can line up any one of lines 80, 81, 82 and 83 to present 75 slot to show suits, points, Aces and Kings, respectively. These are shown from right to left in FIG. 17, there being no marking in Column 85 on the Ace illustrated, because only Kings will carry dots in that position.

Many variations of masking of the cards, either in a group as I prefer, or individually, are possible. Other means for overlapping Dummy are also feasible. For example the edge spacing of the printing in FIG. 1 can be identical to the spaces of overlapping marks 29. This allows the dealer to begin overlapping Defender's Partner freely without a Jacket while non-dealer is arranging Dummy in the Point Count Jacket when playing 2-handed bridge.

Although I prefer to maintain all cards of Dummy unexposed during bidding, it is within the scope of this invention to expose a portion thereof and have the remainder reveal one or more types of the information disclosed.

Additionally, while I utilize the top and bottom edges of the cards for containing the desired bidding information, the same can be accomplished using the side edges. In fact, as can be seen in each of FIGS. 2A–2D, there is a suit marking beneath each card's numerical value. This suit marking can be utilized in place of suit column 11 of FIG. 2A, for example. It can, in fact, provide a reasonably good game of 2-handed bridge with a standard unmarked deck of cards with the players located as in FIG. 13, and the Dummy fully exposed during bidding. This version lacks the competitive bidding aspects of the preferred game, however, which includes the point count and Slam bidding accuracy and chance element.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention which is defined in the appended claims.

What is claimed is:

1. In a 52-card, 4-suit bridge deck used in a bridge game for two or three players at least one of which players bids to contract with an unexposed Dummy hand which is incapable of verbal response, information on the faces of the high cards thereof relating to the point value of each such high card according to a standard point count system, and masking means associated with said deck and having a window therein through which such information can be viewed when the masking means is placed against the card faces.

2. The invention according to claim 1 including information relating to the suits of the cards in locations on the cards different than the point value location, and masking and window means through which such suit information can be viewed when the masking means is placed against the card faces.

3. The invention according to claims 1 or 2 including information relating to the Aces and Kings of the cards of the deck in locations on the cards different than such other information, and masking and window means through which such Ace and King information can be viewed when the masking means is placed against the card faces.

4. The invention according to claims 1 or 2 wherein each of such informations is placed in distinct columnar locations on each of said cards so that each type of information is determined separately of the other information, said masking means and windows being constructed and arranged to reveal one type of information at a time.

5. The invention of claim 4 wherein all such informations are provided at opposed edges of the card faces in reverse order, and wherein said window is elongated to enable viewing a plurality of overlapped cards simultaneously along one of the edges of the cards being viewed.

6. The invention according to claim 2 wherein the majority of the cards of said deck are provided with suit markings at opposed edges, but selected cards are marked at one edge only, and wherein the window for viewing said suit information enables viewing of one edge only.

7. The invention according to claim 1 wherein the point value information may vary at least one point from the true value of the specific high card on which it is provided.

8. In a 52-card, 4-suit bridge deck used in a bridge game for two or three players at least one of which players bids to contract with an unexposed Dummy hand which is incapable of verbal response, first information in first locations on the faces of the high cards along opposed edges thereof relating to the point value of each such high card according to a standard point count system, second information in second locations relating to the suits of the cards along the opposed edges thereof but offset laterally with respect to the first locations, masking means the width of the cards and the length of an overlapped Dummy hand and having an elongated window therein, and, means for overlapping a Dummy hand in facedown condition against said masking means to present adjacent edges only of the overlapped cards to said window to alternately reveal said first and second informations when the masking means is placed against the card faces.

9. The invention according to claim 8 wherein said overlapping means comprises spacing marks provided on the backs of said cards.

10. The invention according to claim 8 including pocket means at the end of the masking means opposite from the window, and wherein said overlapping means comprises spacing marks associated with said pocket means.

11. The invention according to claim 10 wherein spacing marks corresponding to said pocket spacing marks are provided along the length of said window on the side of said masking means opposite said pocket, and wherein consecutive corresponding numbers are placed alongside both sets of spacing marks.

12. The invention according to claim 8 wherein said first and second informations are spaced laterally equidistant from a centerline extending through said cards from edge to edge, wherein said window enables viewing the first information when one face of said masking means is against the card faces and enables viewing the second information when the opposite face of said masking means is against said card faces.

13. The invention according to claim 8 including third information relating solely to the Aces of said deck along opposed edges of said cards, fourth information relating solely to the Kings of said deck along opposed edges of said deck, said third and fourth informations being offset laterally from each other and from said first and second informations, so that neither of the other informations can be viewed through said window whenever viewing either said third or fourth informations.

14. In a 52-card, 4-suit bridge deck used in a bridge game for two or three players at least one of which players bids to contract with an unexposed Dummy hand which is incapable of verbal response, information on the faces of the cards relating to the suit of each card, and masking means including a window through which only such suit information can be viewed when the masking means is placed against the card faces.

15. The invention according to claim 14 wherein said Dummy hand is arranged to be overlapped along one edge and aligned along an edge at right angles to said one edge, and wherein said masking means covers the faces of the Dummy hand in their entirety when the masking means is placed against the faces and the Dummy hand is turned over, except for viewing aligned overlapped edges of the faces containing the suit information through said window, which window is elongated in the direction of overlapping to enable multiple cards to be viewed simultaneously.

16. A method of playing two-handed bridge with four playing hands of 13 cards each, comprising the steps of:

providing a means for identifying the suit of each individual card of the bridge deck without viewing the face of such card, dealing the four playing hands, one to each player situated in adjacent playing locations and one hand opposite each player, designating one of said opposite hands a Dummy hand to be exposed and played by the player opposite the Dummy hand designating the other of said opposite hands a defending hand which remains unexposed during play of the hand but one card of which is played on each trick, utilizing said identifying means to segregate the cards of at least one of the suits of said defending hand from the remaining cards thereof, and, upon playing of the hand, retrieving and playing cards from said one suit of said defending hand whenever that suit is led by another player, and playing a card from other than said suit when that suit has been depleted.

17. The method according to claim 16 wherein said one suit is the trump suit in which said hand is played.

18. The method according to claim 16 wherein the majority of the cards of said defending hand are segregated into separate suit packs and played from their respective packs, when the corresponding suit is led by another hand.

* * * * *